US009521896B2

(12) United States Patent
Peterson

(10) Patent No.: US 9,521,896 B2
(45) Date of Patent: Dec. 20, 2016

(54) RETRACTABLE AND EXTENDABLE TETHER DEVICE

(71) Applicant: Patsi Peterson, Bozeman, MT (US)

(72) Inventor: Patsi Peterson, Bozeman, MT (US)

( * ) Notice: Subject to any disclaimer, the term of this patent is extended or adjusted under 35 U.S.C. 154(b) by 13 days.

(21) Appl. No.: 14/545,160

(22) Filed: Mar. 31, 2015

(65) Prior Publication Data

US 2016/0286942 A1 Oct. 6, 2016

(51) Int. Cl.
*A45F 5/00* (2006.01)

(52) U.S. Cl.
CPC ..... *A45F 5/00* (2013.01); *A45F 2200/0516* (2013.01); *Y10S 224/93* (2013.01)

(58) Field of Classification Search
CPC ..... A45F 2200/0508; A45F 2200/0516; A45F 2200/0525; A45F 5/004; Y10S 224/93; Y10T 24/1397; Y10T 24/314–24/318
USPC . 224/162, 930; 455/575.6; D3/218; 24/3.13, 24/115 K, 298, 300–302
See application file for complete search history.

(56) References Cited

U.S. PATENT DOCUMENTS 3,482,748 A * 12/1969 Roberts, Jr. ..... A45F 5/00 224/626
5,887,776 A * 3/1999 Munoz ..... A45F 5/00 224/269
5,938,137 A * 8/1999 Poulson ..... A45F 5/004 242/379.2
6,502,727 B1 * 1/2003 Decoteau ..... A45F 5/004 224/162
7,614,689 B2 11/2009 Fowler et al. ..... 297/188.06
7,665,684 B2 2/2010 Salentine et al. ..... 242/379.2
7,755,483 B2 7/2010 Schmidt ..... 340/568.1
8,737,066 B1 * 5/2014 Block ..... A45F 5/00 224/217
2003/0042348 A1 * 3/2003 Salentine ..... A45F 5/004 242/380
2005/0072819 A1 * 4/2005 Maldonado ..... A45F 5/004 224/162
2005/0258203 A1 11/2005 Weaver ..... 224/162
2006/0113345 A1 * 6/2006 Zoullas ..... A45F 5/00 224/600
2007/0213104 A1 * 9/2007 Fields ..... A45F 5/004 455/575.6
2008/0083797 A1 * 4/2008 Myers ..... A45C 13/20 224/217
2008/0227419 A1 * 9/2008 Traub ..... H04B 1/3888 455/186.1
2009/0016559 A1 1/2009 Cleary ..... 381/375
2010/0171021 A1 * 7/2010 Smith ..... A45C 13/30 248/558
2011/0130174 A1 * 6/2011 Kroupa ..... H04M 1/05 455/569.1
2015/0157116 A1 * 6/2015 Williams ..... A45F 5/004 224/162

* cited by examiner

*Primary Examiner* — Justin Larson
*Assistant Examiner* — Scott McNurlen
(74) *Attorney, Agent, or Firm* — Bernard S. Hoffman

(57) ABSTRACT

A retractable and extendable tether device that attaches to a hand-held electronic device and selectively replaceably attaches the hand-held electronic device to a user. The retractable and extendable tether device includes a retractor, a retainer, and a tether. The retractor replaceably attaches to the user. The retainer attaches to the hand-held electronic device. The tether retracts into, and extends from, the retractor and attaches to the retainer so as to selectively replaceably attach the hand-held electronic device to the user.

20 Claims, 4 Drawing Sheets

RETRACTABLE AND EXTENDABLE TETHER DEVICE

1. CROSS REFERENCE TO RELATED APPLICATIONS

The instant non-provisional patent application claims priority from provisional patent application No. 61/967,975, filed on Mar. 31, 2014, entitled TETHER DEVICE, and incorporated herein in its entirety by reference thereto.

2. BACKGROUND OF THE INVENTION

A. Field of the Invention

The embodiments of the present invention relate to a retractable and extendable tether device, and more particularly, the embodiments of the present invention relate to a retractable and extendable tether device for attaching to a hand-held electronic device and for selectively replaceably attaching the hand-held electronic device to a user.

B. Description of the Prior Art

Small and hand-held electronic devices have become commonplace in society. Hand-held computers, calculators, cellular phones, beepers, and the like are carried by millions of people. As hand-held electronic devices became more sophisticated, they became smaller and lighter. A consequence of this evolution is that many hand-held electronic devices are so small and lightweight that they can fall from a pocket or be dropped from a belt hook without a person realizing the loss.

Thus, there exists a need for a retractable and extendable tether device for attaching to a hand-held electronic device and for selectively replaceably attaching the hand-held electronic device to a user. The retractable and extendable tether device will be a life and money saver for moms, dads, and care-givers by eliminating 15 minutes of every hour looking through purses and coat pockets for electronic devices, such as IPods and cell phones.

Numerous innovations for tether device have been provided in the prior art, which will be described below in chronological order to show advancement in the art, and which are incorporated herein in their entirety by reference thereto. Even though these innovations may be suitable for the specific individual purposes to which they address, however, they differ from the embodiments of the present invention in that they do not teach a retractable and extendable tether device for attaching to a hand-held electronic device and for selectively replaceably attaching the hand-held electronic device to a user.

(1) U.S. Pat. No. 6,502,727 B1 to Decoteau.

U.S. Pat. No. 6,502,727 B1—issued to Decoteau on Jan. 7, 2003 in U.S. class 224 and subclass 162—teaches a device and associated method for attaching a electronic device to a tether, so that the electronic device cannot be stolen or inadvertently lost. The device includes a housing. Within the housing is contained a spool and a spring for rewinding the spool. A tether extends from the spool and out of the housing. The tether terminates outside of the housing with a connector element. The connector element is selectively attachable to the electronic device. As the tether is wound on the spool, the connector element is drawn toward an attachment area on the housing of the device. The connector element and the attachment area are magnetically attracted. As such, when the connector element approaches the attachment area on the housing, the connector element becomes magnetically affixed to the attachment area, thereby joining the electronic device to the housing in a fixed orientation.

(2) United States Patent Application Publication Number US 2005/0258203 A1 to Weaver.

United States Patent Application Publication Number US 2005/0258203 A1—published to Weaver on Nov. 24, 2005 in U.S. class 224 and subclass 162—teaches a retractable tether device for attachment to hand tools and power tools. The device includes a retractable tether or cord attached to a reel for extension and retraction thereof. The distal end of the cord includes an attachment device for connecting the cord to a hand tool or other implement. A cord-retaining arrangement is attached on the exterior of the housing to selectively retain the cord against tension from the reel and from the power tool.

(3) United States Patent Application Publication Number US 2009/0016559 A1 to Cleary.

United States Patent Application Publication Number US 2009/0016559 A1—published to Cleary on Jan. 15, 2009 in U.S. class 381 and subclass 375—teaches wearable holding apparatus and methods for securing and storing wireless or wired telecommunication and electronic devices. The apparatus includes a holding unit attached on a user's body, the clothing or accessories of a user, or otherwise proximate to the user, and has one or more cords attached to the device during both use and non-use. The cord is dispensed from a cord-retracting mechanism for use, and the cord is retracted back into the mechanism following use.

(4) U.S. Pat. No. 7,614,689 B2 to Fowler et al.

U.S. Pat. No. 7,614,689 B2—issued to Fowler et al. on Nov. 10, 2009 in U.S. class 297 and subclass 188.06—teaches a seat-integrated-tether-system for use in a vehicle for the secure placement of an article on a vehicle seat. One or more retractable or extendable tethers are adapted for attachment to the side of the vehicle seat. By use of the system by the front passenger seat of a vehicle, the driver has access to the contents of the retained article that may be an item storage article, such as an open top bag, a case, or a storage net.

(5) U.S. Pat. No. 7,665,684 B2 to Salentine et al.

U.S. Pat. No. 7,665,684 B2—issued to Salentine et al. on Feb. 23, 2010 in U.S. class 242 and subclass 379.2—teaches a retractable tether that is used in conjunction with personal communication devices, such as a cell phone, a pager, or a PDA, and a mounting system for the prevention of loss or damage. The retracting tether is clipped to a belt, pants, or a purse next to the location in which the device is being held or stored. Should the device be dropped or dislodged from the device's clip mount, holster, or storage pocket the retracting tether prevents the device from loss or damage. A separation mechanism is also incorporated to allow the device to be removed from the retractable tether.

(6) U.S. Pat. No. 7,755,483 B2 to Schmidt.

U.S. Pat. No. 7,755,483 B2—issued to Schmidt on Jul. 13, 2010 in U.S. class 340 and subclass 568.1—teaches an apparatus for holding articles, such as keys, which is attachable to a person's clothing, a handbag, or a purse. A physical or electronic tether is used to allow the user to use the articles stored thereupon without removing them from the holder or from their clothing, handbag, purse, briefcase, or other hand carried item. The tension on the tether is manageable by the use of a tension management system, and the article is tracked by use of the tether. Infrared, radio frequency, and transponder and polling versions are also taught.

It is apparent that numerous innovations for tether devices have been provided in the prior art that are adapted to be used. Furthermore, even though these innovations may be suitable for the specific individual purposes to which they address, however, they would not be suitable for the purposes of the embodiments of the present invention as heretofore described, namely, a retractable and extendable tether device for attaching to a hand-held electronic device and for selectively replaceably attaching the hand-held electronic device to a user.

3. SUMMARY OF THE INVENTION

Thus, an object of the embodiments of the present invention is to provide a retractable and extendable tether device for attaching to a hand-held electronic device and for selectively replaceably attaching the hand-held electronic device to a user, which avoids the disadvantages of the prior art.

Briefly stated, another object of the embodiments of the present invention is to provide a retractable and extendable tether device that attaches to a hand-held electronic device and selectively replaceably attaches the hand-held electronic device to a user. The retractable and extendable tether device includes a retractor, a retainer, and a tether. The retractor replaceably attaches to the user. The retainer attaches to the hand-held electronic device. The tether retracts into, and extends from, the retractor and attaches to the retainer so as to selectively replaceably attach the hand-held electronic device to the user.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

4. BRIEF DESCRIPTION OF THE FIGURES OF THE DRAWING

The figures of the drawing are briefly described as follows.

Figure 1:
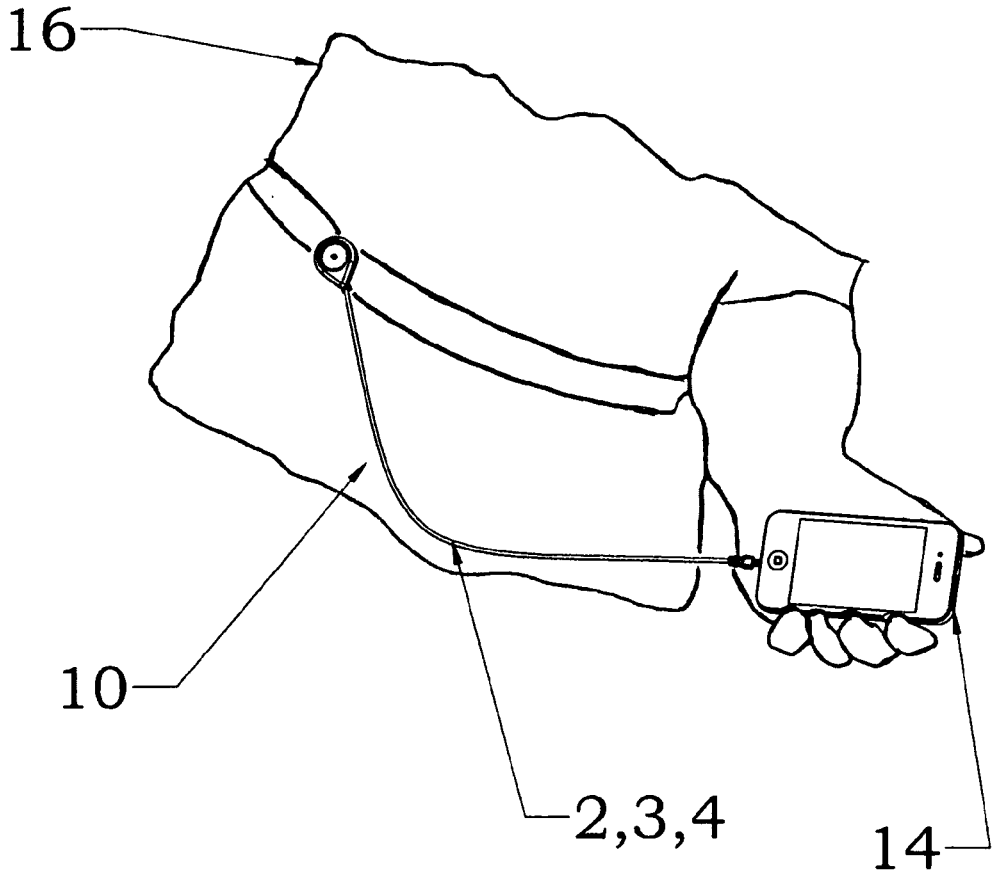
FIG. 1 is a diagrammatic perspective view of the retractable and extendable tether device of the embodiments of the present invention attached to a hand-held electronic device and selectively replaceably attaching the hand-held electronic device to a user.
Figure 3:
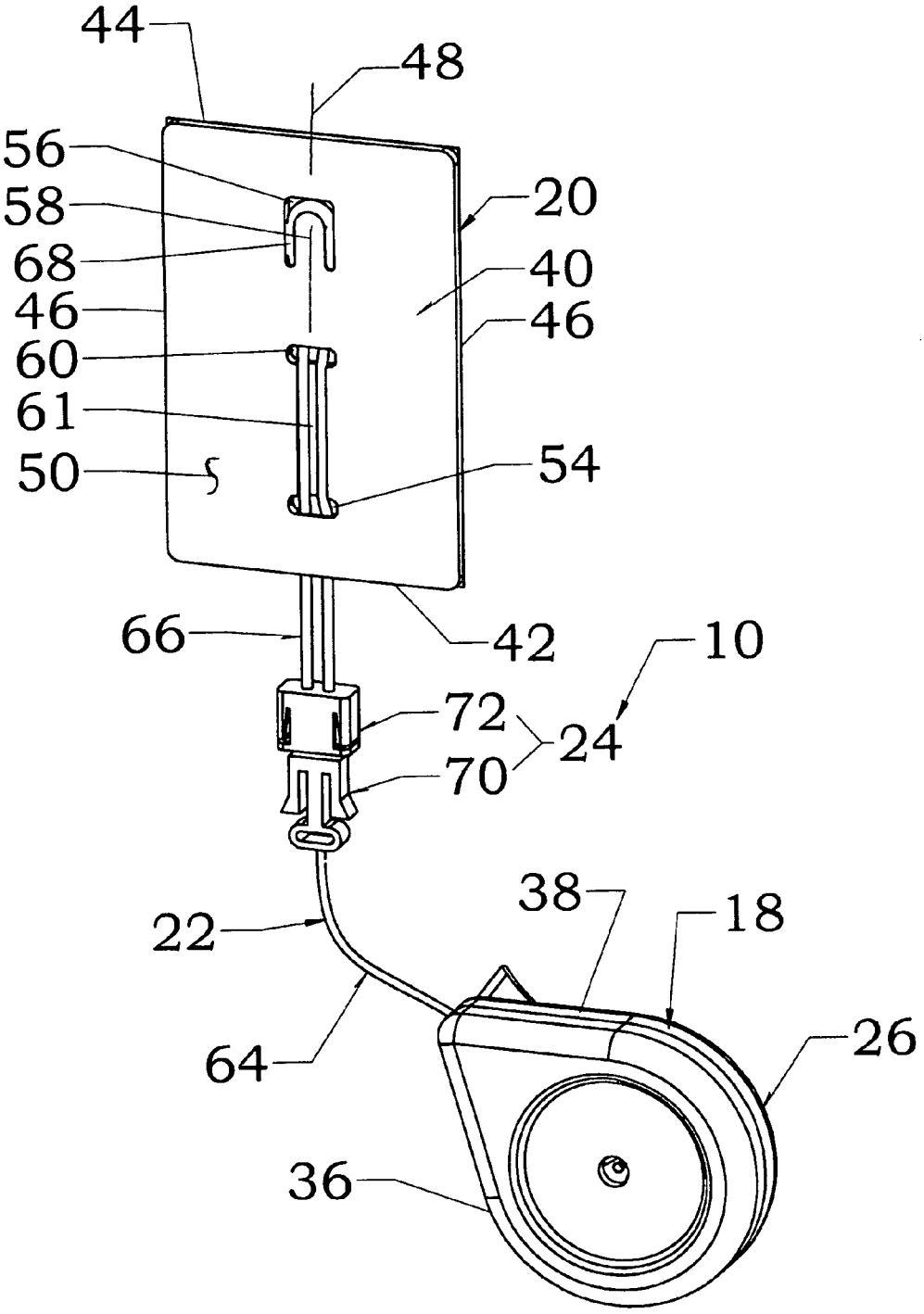
Figure 4:
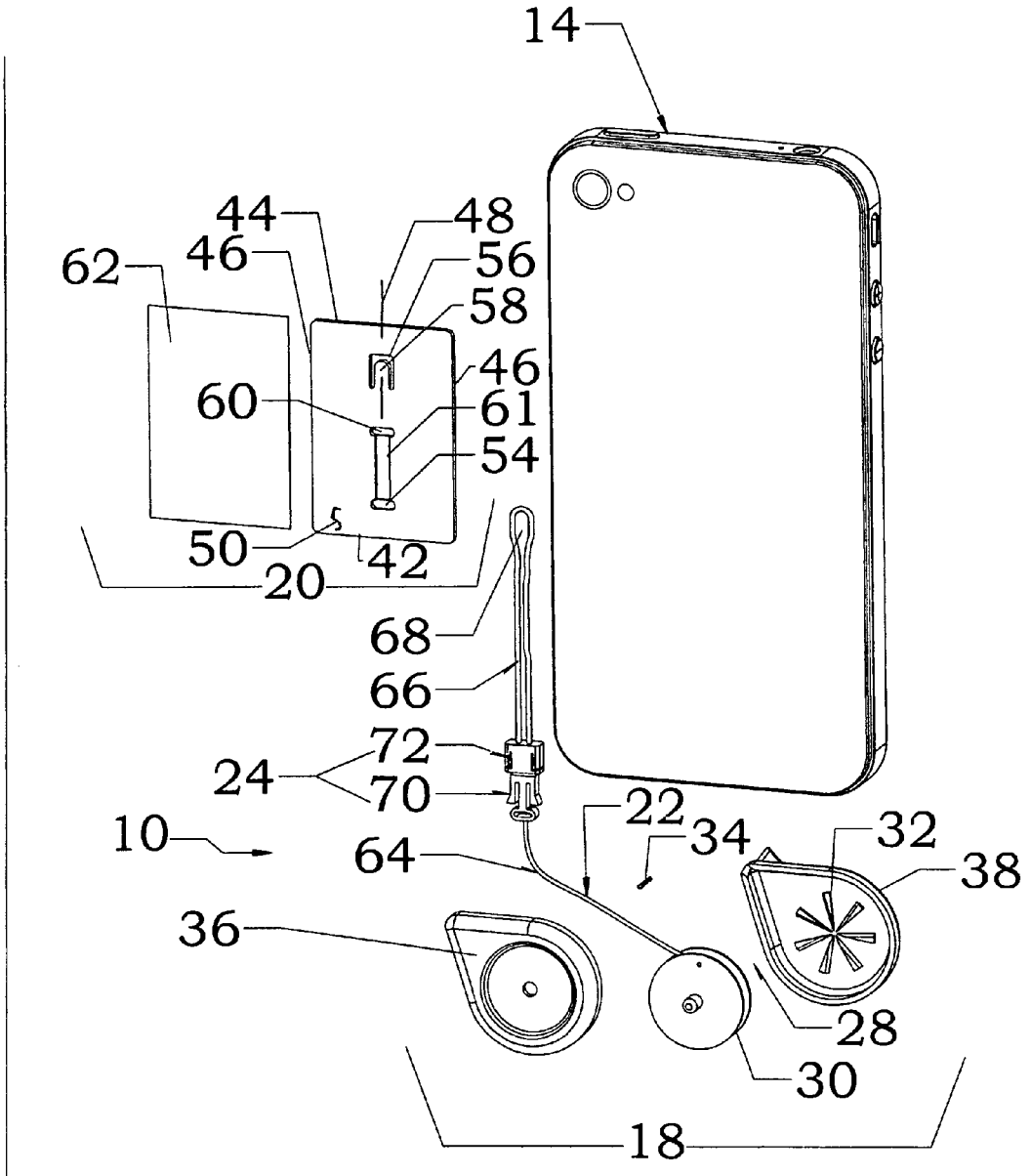

FIG. 3 is an enlarged diagrammatic perspective view of the retractable and extendable tether device of the embodiments of the present invention identified by ARROW 3 in FIG. 1 illustrating the opposite side of the retainer thereof; and FIG. 4 is an enlarged and exploded diagrammatic perspective view of the retractable and extendable tether device of the embodiments of the present invention identified by ARROW 4 in FIG. 1.

5. LIST OF REFERENCE NUMERALS UTILIZED IN THE FIGURES OF THE DRAWING

A. Introduction

10 retractable and extendable tether device for attaching to hand-held electronic device 14 and for selectively replaceably attaching hand-held electronic device 14 to user 16
14 hand-held electronic device
16 user

B. Configuration of Retractable and Extendable Tether Device 10

18 retractor for replaceably attaching to user 16
20 retainer for attaching to hand-held electronic device 14
22 tether for selectively replaceably attaching hand-held electronic device 14 to user 16
24 disconnect mechanism for allowing hand-held electronic device 14 to be separated from user 16 by disconnecting retainer 20 from retractor 18

C. Specific Configuration of Retractor 18

26 housing of retractor 18
28 ratchet mechanism of retractor 18
30 spool of ratchet mechanism 28 of retractor 18
32 teeth of ratchet mechanism 28 of retractor 18
34 spring of ratchet mechanism 28 of retractor 18
36 front half of housing 26 of retractor 18
38 rear half of housing 26 of retractor 18

D. Specific Configuration of Retainer 20

40 plate of retainer 20 for attaching to hand-held electronic device 14
42 initial short edge of plate 40 of retainer 20
44 terminal short edge of plate 40 of retainer 20
46 pair of long edges of plate 40 of retainer 20
48 longitudinal centerline of plate 40 of retainer 20
50 front face of plate 40 of retainer 20
52 rear face of plate 40 of retainer 20
54 initial through slot of plate 40 of retainer 20
56 terminal through slot of plate 40 of retainer 20
58 tab of plate 40 of retainer 20
60 intermediate through slot of plate 40 of retainer 20
61 blind slot of plate 40 of retainer 20
62 double-sided tape patch of retainer 20 for attaching retainer 20 to hand-held electronic device 14

E. Specific Configuration of Tether 22

64 proximal portion of tether 22
66 distal portion of tether 22
68 loop of distal portion of tether 22

F. Specific Configuration of Disconnect Mechanism 24

70 male portion of disconnect mechanism 24
72 female portion of disconnect mechanism 24

6. DETAILED DESCRIPTION OF THE PREFERRED EMBODIMENTS

A. The Introduction

Referring now to the figures, in which like numerals indicate like parts, and particularly to FIG. 1, the retractable and extendable tether device of the embodiments of the present invention is shown generally at 10 for attaching to a hand-held electronic device 14 and for selectively replaceably attaching the hand-held electronic device 14 to a user 16.

B. The Configuration of the Retractable and Extendable Tether Device 10

Figure 2:
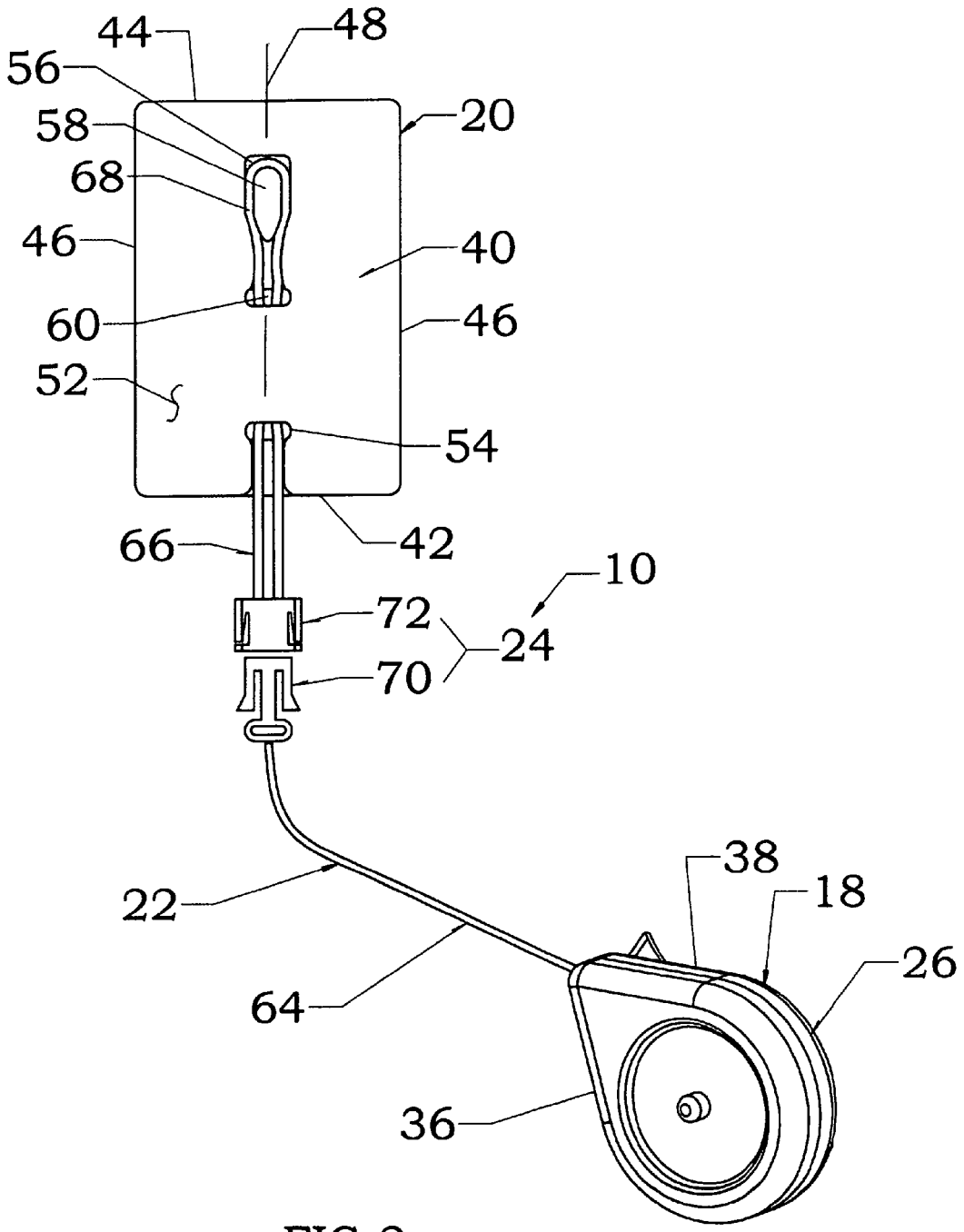
FIG. 2 is an enlarged diagrammatic perspective view of the retractable and extendable tether device of the embodiments of the present invention identified by ARROW 2 in FIG. 1 illustrating one side of the retainer thereof.

The configuration of the retractable and extendable tether device 10 can best be seen in FIGS. 2-4, and as such, will be discussed with reference thereto.

The retractable and extendable tether device 10 comprises a retractor 18, a retainer 20, and a tether 22. The retractor 18 is for replaceably attaching to the user 16. The retainer is for attaching to the hand-held electronic device 14. The tether 22 retracts into, and extends from, the retractor 18 and attaches to the retainer 20 for selectively replaceably attaching the hand-held electronic device 14 to the user 16.

The retractable and extendable tether device 10 further comprises a disconnect mechanism 24.

The disconnect mechanism 24 is operatively connected to, and selectively severs, the tether 18 for allowing the hand-held electronic device 14 to be separated from the user 16 by disconnecting the retainer 20 from the retractor 18.

C. The Specific Configuration of the Retractor 18

The retractor 18 comprises a housing 26 and a ratchet mechanism 28.

The ratchet mechanism 28 of the retractor 18 is contained within the housing 26 of the retractor 18, and comprises a spool 30, teeth 32, and a spring 34. The spool 30 of the ratchet mechanism 28 of the retractor 18 has the tether 22 wrapped therearound so as to allow the tether 22 to extend from, and retract into, the housing 26 of the retractor 18.

The housing 26 of the retractor 18 is made of plastic, has a belt clip or a pin for attaching onto a purse, a backpack, a waist band, a pocket, a vehicle seat back, or a diaper bag, and comprises two parts. The two parts of the housing 26 of the retractor 18 include a front half 36 and a rear half 38.

D. The Specific Configuration of the Retainer 20

The retainer 20 includes a plate 40.

The plate 40 of the retainer 20 is for attaching to the hand-held electronic device 14, is rectangular-shaped, and as such, has an initial short edge 42, a terminal short edge 44, a pair of long edges 46, a longitudinal centerline 48, a front face 50, and a rear face 52, and is flat for easily fitting under the cover of any hand-held electronic device 14.

The plate 40 of the retainer 20 further has an initial through slot 54.

The initial through slot 54 of the plate 40 of the retainer 20 extends sideways therethrough, is disposed along, and perpendicular to, the longitudinal centerline 48 of the plate 40 of the retainer 20, and is in close proximity to the initial short edge 42 of the plate 40 of the retainer 20.

The plate 40 of the retainer 20 further has a terminal through slot 56.

The terminal through slot 56 of the plate 40 of the retainer 20 is disposed along the longitudinal centerline 48 of the plate 40 of the retainer 20, is in close proximity to the terminal short edge 44 of the plate 40 of the retainer 20, and is inverted U-shaped so as to form a tab 58 having an inverted U-shaped perimeter.

The plate 40 of the retainer 20 further has an intermediate through slot 60.

The intermediate through slot 60 of the plate 40 of the retainer 20 extends sideways therethrough, is disposed along, and perpendicular to, the longitudinal centerline 48 of the plate 40 of the retainer 20, and is disposed between the initial through slot 54 of the plate 40 of the retainer 20 and the terminal through slot 56 of the plate 40 of the retainer 20.

The plate 40 of the retainer 20 further has a blind slot 61.

The blind slot 61 of the plate 40 of the retainer 20 extends along the front face 50 of the plate 40 of the retainer 20 from, and communicates with, the initial through slot 54 of the plate 40 of the retainer 20 to, and communicates with, the intermediate through slot 60 of the plate 40 of the retainer 20, and is disposed along the longitudinal centerline 48 of the plate 40 of the retainer 20.

The retainer 20 further includes a double-sided tape patch 62.

The double-sided tape patch 62 of the retainer 20 is made by the 3M Corporation, has a 6-10 lb. shear strength, is disposed on the rear face 52 of the plate 40 of the retainer 20, and is for attaching the retainer 20 to the hand-held electronic device 14.

E. The Specific Configuration of the Tether 22

The tether 22 is a cord having a 6 lb tensile strength, is approximately 3 feet long, and has a proximal portion 64 and a distal portion 66.

The proximal portion 64 of the tether 22 is singular, wraps around the spool 30 of the ratchet mechanism 28 of the retractor 18 so as to allow the proximal portion 64 of the tether 22 to extend to the disconnect mechanism 24 from, and retract into, the housing 26 of the retractor 18, and be locked at any position therebetween.

The distal portion 66 of the tether 22 extends from the disconnect mechanism 24, and is doubled so as to form a loop 68. The loop 68 of the distal portion 66 of the tether 22 first extends along the rear face 52 of the plate 40 of the retainer 20, in proximity to the initial short edge 42 of the plate 40 of the retainer 20, to the initial through slot 54 of the plate 40 of the retainer 20, then passes through the initial through slot 54 of the plate 40 of the retainer 20 to the front face 50 of the plate 40 of the retainer 20, then extends in the blind slot 61 of the plate 40 of the retainer 20 to the intermediate through slot 60 of the plate 40 of the retainer 20, than passes through the intermediate through slot 60 of the plate 40 of the retainer 20 to the rear face 52 of the plate 40 of the retainer 20, then extends along the rear face 52 of the plate 40 of the retainer 20 to the terminal through slot 56 of the plate 40 of the retainer 20, and then engages around the inverted U-shaped perimeter of the tab 58 of the plate 40 of the retainer 20, thereby affixing the tether 22 to the retainer 20, with a leader portion of the distal portion 66 of the tether 22 being for extending out of the recharging port of the cover of the hand-held electronic device 14.

The double-sided tape patch 62 of the retainer 20 holds the distal portion 66 of the tether 22 against the rear face 52 of the plate 40 of the retainer 20.

F. The Specific Configuration of the Disconnect Mechanism 24

The disconnect mechanism 24 includes a male portion 70 and a female portion 72.

The male portion 70 of the disconnect mechanism 24 is affixed to the proximal portion 64 of the tether 22, while the female portion 72 of the disconnect mechanism 24 is affixed to the distal portion 66 of the tether 22.

G. The Impressions

It will be understood that each of the elements described above, or two or more together, may also find a useful application in other types of constructions differing from the types described above.

While the embodiments of the present invention have been illustrated and described as embodied in a retractable and extendable tether device for attaching to a hand-held electronic device and for selectively replaceably attaching the hand-held electronic device to a user, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A retractable and extendable tether device for attaching to a hand-held electronic device and for selectively replaceably attaching the hand-held electronic device to a user, comprising:

a) a retractor;

b) a retainer;

c) a tether; and d) a disconnect mechanism;

wherein said retractor is for replaceably attaching to the user;

wherein said retainer is for attaching to the hand-held electronic device; and wherein said tether retracts into, and extends from, said retractor and replaceably attaches to said retainer so as to selectively replaceably attach the hand-held electronic device to the user;

wherein said disconnect mechanism is operatively connected to, and selectively severs, said tether for allowing the hand-held electronic device to be separated from the user by disconnecting said retainer from said retractor;

wherein said retainer includes a plate;

wherein said plate of said retainer is for replaceably attaching to the hand-held electronic device;

wherein said plate of said retainer is rectangular-shaped, and as such, has:

a) an initial short edge;

b) a terminal short edge c) a pair of long edges;

d) a longitudinal centerline;

e) a front face; and f) a rear face;

wherein said plate of said retainer further has:

a) an initial through slot;

b) a terminal through slot;

c) an intermediate through slot; and d) a blind slot;

wherein said retainer includes a double-sided tape patch;

wherein said double-sided tape patch of said retainer is:

a) for attaching said retainer to the hand-held electronic device; and b) disposed on said rear face of said plate of said retainer;

wherein said blind slot of said plate of said retainer extends along said front face of said plate of said retainer from, and communicates with, said initial through slot of said plate of said retainer to, and communicates with, said intermediate through slot of said plate of said retainer, and is disposed along said longitudinal centerline of said plate of said retainer;

wherein said terminal through slot of said plate of said retainer forms a tab;

wherein said tab of said plate of said retainer has an inverted U-shaped perimeter;

wherein said tether has:

a proximal portion; and b) a distal portion;

wherein said proximal portion of said tether is singular;

wherein said distal portion of said tether:

a) extends from said disconnect mechanism; and b) is doubled so as to form a loop; and wherein said loop of said distal portion of said tether first extends along said rear face of said plate of said retainer, in proximity to said initial short edge of said plate of said retainer, to said initial through slot of said plate of said retainer, then passes through said initial through slot of said plate of said retainer to said front face of said plate of said retainer, then extends in said blind slot of the plate of the retainer to said intermediate through slot of said plate of said retainer, then passes through said intermediate through slot of said plate of said retainer to said rear face of said plate of said retainer, then extends along said rear face of said plate of said retainer to said terminal through slot of said plate of said retainer, and then engages around said inverted U-shaped perimeter of said tab of said plate of said retainer.

2. The retractable and extendable tether device of claim 1, wherein said retractor comprises:

a) a housing; and b) a ratchet mechanism;

wherein said ratchet mechanism of said retractor is contained within said housing of said retractor.

3. The retractable and extendable tether device of claim 2, wherein said ratchet mechanism of said retractor comprises:

a) a spool;

b) teeth; and c) a spring;

wherein said spool of said ratchet mechanism of said retractor has said tether wrapped therearound so as to allow said tether to extend from, and retract into, said housing of said retractor.

4. The retractable and extendable tether device of claim 2, wherein said housing of said retractor comprises two parts; and wherein said two parts of said housing of said retractor include:

a) a front half; and b) a rear half.

5. The retractable and extendable tether device of claim 1, wherein said initial through slot of said plate of said retainer extends sideways therethrough.

6. The retractable and extendable tether device of claim 1, wherein said initial through slot of said plate of said retainer is disposed along said longitudinal centerline of said plate of said retainer.

7. The retractable and extendable tether device of claim 1, wherein said initial through slot of said plate of said retainer is disposed perpendicular to said longitudinal centerline of said plate of said retainer.

8. The retractable and extendable tether device of claim 1, wherein said initial through slot of said plate of said retainer is in close proximity to said initial short edge of said plate of said retainer.

9. The retractable and extendable tether device of claim 1, wherein said terminal through slot of said plate of said retainer is disposed along said longitudinal centerline of said plate of said retainer.

10. The retractable and extendable tether device of claim 1, wherein said terminal through slot of said plate of said retainer is in close proximity to said terminal short edge of said plate of said retainer.

11. The retractable and extendable tether device of claim 1, wherein said terminal through slot of said plate of said retainer is inverted U-shaped.

12. The retractable and extendable tether device of claim 1, wherein said intermediate through slot of said plate of said retainer extends sideways therethrough.

13. The retractable and extendable tether device of claim 1, wherein said intermediate through slot of said plate of said retainer is disposed along said longitudinal centerline of said plate of said retainer.

14. The retractable and extendable tether device of claim 1, wherein said intermediate through slot of said plate of said retainer is perpendicular to said longitudinal centerline of said plate of said retainer.

15. The retractable and extendable tether device of claim 1, wherein said intermediate through slot of said plate of said retainer is disposed between said initial through slot of said plate of said retainer and said terminal through slot of said plate of said retainer.

16. The retractable and extendable tether device of claim 1, wherein said proximal portion of said tether wraps around said spool of said ratchet mechanism of said retractor so as to allow said proximal portion of said tether to extend to said disconnect mechanism from, and retract into, said housing of said retractor.

17. The retractable and extendable tether device of claim 1, wherein said double-sided tape patch of said retainer holds said distal portion of said tether against said rear face of said plate of said retainer.

18. The retractable and extendable tether device of claim 1, wherein said disconnect mechanism includes:

a) a male portion; and b) a female portion.

19. The retractable and extendable tether device of claim 18, wherein said male portion of said disconnect mechanism is affixed to said proximal portion of said tether.

20. The retractable and extendable tether device of claim 18, wherein said female portion of said disconnect mechanism is affixed to said distal portion of said tether.

* * * * *